US005547363A

United States Patent [19]

Takai et al.

[11] Patent Number: 5,547,363

[45] Date of Patent: Aug. 20, 1996

[54] NOZZLE FOR SPINNING PITCH-BASED CARBON FIBERS

[75] Inventors: Yasuyuki Takai; Tetsuo Yamada; Toshifumi Kawamura, all of Ibaragi; Susumu Shimizu, Tokyo; Haruki Yamasaki, Kanagawa, all of Japan

[73] Assignees: Petoca, Ltd.; Tanaka Kikinzoku Kogyo K.K., both of Tokyo, Japan

[21] Appl. No.: 462,544

[22] Filed: Jun. 5, 1995

Related U.S. Application Data

[63] Continuation of Ser. No. 246,571, May 20, 1994, abandoned, which is a continuation of Ser. No. 944,654, Sep. 14, 1992, abandoned.

[30] Foreign Application Priority Data

Sep. 13, 1991 [JP] Japan ..... 3-262787

[51] Int. Cl.[6] ..... D01D 4/02

[52] U.S. Cl. ..... 425/376.1; 264/29.2; 264/176.1; 425/464; 425/467; 425/378.2

[58] Field of Search ..... 425/461, 464, 425/465, 466, 467, 376.1, 378.2; 264/29.2, 177.13, 176.1

[56] References Cited

U.S. PATENT DOCUMENTS

| | | | |
|---|---|---|---|
| 1,822,904 | 9/1931 | Penza | 425/465 |
| 2,073,271 | 3/1937 | Webb | 264/177.13 |
| 3,436,448 | 4/1969 | Mogensen et al. | 425/464 |
| 4,261,945 | 4/1981 | Pfeiffer et al. | 264/177.13 |
| 4,316,714 | 2/1982 | Pfeiffer et al. | 264/177.13 |
| 4,717,331 | 1/1989 | Maeda et al. | 425/464 |
| 4,818,449 | 4/1989 | Yamada et al. | 264/29.2 |

*Primary Examiner*—Jay H. Woo
*Assistant Examiner*—Joseph Leyson
*Attorney, Agent, or Firm*—Sughrue, Mion, Zinn, Macpeak & Seas

[57] ABSTRACT

Disclosed herein is a spinning nozzle having one or more discharge openings and one or more introduction openings located upstream the discharge openings for producing pitch-based carbon fibers characterized by the presence of one or more spiral members in each introduction openings. According to the nozzle of the present invention, part of the pitch which is introduced to the introduction opening flows down along the spiral member while the flow of the pitch is affected by the spiral member. The remaining pitch flows into the discharge opening without being in contact with the spiral member, and then both are spun after being mixed through the discharge opening to prepare carbon fibers having a random structure. Especially, the carbon fibers of higher performances can be prepared when a spiral having uneven outer diameters is employed.

4 Claims, 1 Drawing Sheet

NOZZLE FOR SPINNING PITCH-BASED CARBON FIBERS

This is a continuation application of application Ser. No. 08/246,571 filed on May 20, 1994, now abandoned, which is a continuation of application Ser. No. 07/944,654, filed Sep. 14, 1992, now abandoned.

BACKGROUND OF THE INVENTION

The present invention relates to a nozzle for spinning optically anisotropic pitch to prepare carbon fibers having high strength and high modulus of elasticity, and more in particular to a spinning nozzle for preparing pitch-based carbon fibers excellent in homogeneity having no defects such as wedge-like cracks parallel to the fiber axis.

Carbon fibers of a high performance grade prepared from optically anisotropic pitch possess such characteristics that the fibers can be prepared less expensively than PAN-based ones and high elasticity can be easily realized by means of graphitization. On the other hand, the pitch-based carbon fibers possess such drawbacks as low strength and low elongation so that the application thereof is rather limited.

Various researches and developments have been conducted to improve the above dynamical properties of the pitch-based carbon fibers. One of the researches and the developments is a method of treating precursor pitch which includes, for example, a method consisting of discharging light components which prevent formation of mesophase to depress excessive condensation polymerization for precipitating mesophase, a method of separating and removing improper light or heavy components by means of a solvent, a method of depressing the formation of the heavy components by discontinuing the formation of the mesophase and separating the anisotropic components and the light components on settling and the like. In addition, other processes which are directed to obtaining a preferable structure for spinning by improving the fluidity of the pitches by means of controlling the molecular weights have been developed including a Domant mesophase method which consists of hydrogenating anisotropic pitch to form isotropic pitch and thermally treating the isotropic pitch to convert into the anisotropic pitch and a premesophase method which consists of hydrogenating and thermally treating isotropic pitch.

The research and development of processes of melt spinning, infusibilization and heat treatment employing the precursor pitch thus prepared as well as the development of the raw material are conducted. It is known that the dynamical characteristics of the carbon fibers are remarkably influenced by a method of forming the orientation of the molecules and a cross sectional fiber structure formed during the melt spinning.

Structural parameters of a microscopic structure governing the dynamical characteristics of the pitch-based carbon fibers include the degree of preferential orientation of a carbon layer along a fiber axis, the cross sectional fiber structure, the shape and the size of closed pores, the distance between adjacent carbon hexagonal layers, the thickness of parallel stacked layers, the length of the respective layers, the surface and internal structures, nonuniformity, chemical compositions, existence of impurities and the like.

On the other hand, a macroscopic fiber structure is deeply related to properties of a fiber, and a cross sectional shape of a fiber and macroscopic orientation of carbon layers considerably influence the dynamical characteristics. It is realized that the optically anisotropic carbon fibers are likely to form relatively broad layers, and for example if its orientation of the fiber cross section possesses a radical structure, cracks are liable to be created along the fiber axis during the heat treatment to largely decrease the strength. The factors dominating the said orientation depend on, as mentioned earlier, the raw material, the temperature of the spinning and the structure of a spinning nozzle.

The spinning conditions influence the orientation of the carbon layers; e.g., the orientation is determined by the temperature of the pitch, the change of the flow circumstances of the melted pitch flowing through the spinning nozzle based on the structure of the spinning nozzle, and the carrying out of a thinning step of the fibers discharged from a discharge opening.

The orientation of the molecules constituting the pitch at the time of spinning is generally known to be perpendicular to the wall surface of the spinning nozzle and parallel to a free interface of a gas and the like by means of surface tension. Since the spinning nozzle generally possesses a circular or deformed cross section and the raw material is discharged through the nozzle, the spun fibers are likely to have a radial structure perpendicular to the wall surface of the spinning nozzle. This radial structure likely to be produced especially in the case of the circular cross section, is liable to create cracks in the subsequent infusibilizing and heat treating processes, and is accompanied by many problems for elevating the mechanical strength.

Various methods have been developed which prevent the formation of the cracks due to the radial structure of the carbon fibers obtained from the optically anisotropic pitch. The representative ones include a method in which metallic or inorganic crushed powders, fine powders or ultra-fine sintered powders are packed in the introduction part of a nozzle as shown in Japanese patent laid open gazette No. 61-258023 and a method in which a non-porous longitudinal molded element for forming a space constituting a path for a melt is located in an introduction opening as shown in Japanese patent laid open gazette No. 60-259609. The both methods intend to obtain carbon fibers having the random structure or the like with no cracks by means of controlling the flow of pitch in the introduction opening.

However, in reality, a nozzle with plural openings should be employed for industrially preparing the carbon fibers so that it is quite difficult to make uniform the pressure drops of the respective opening in the former method consequently resulting in a problem that stable spinning cannot be achieved due to the nonuniformity of the fiber diameters of the respective openings. On the other hand, since, in the latter method, the molded element in the introduction opening forms the path for the melt between the molded element and the inner wall of the opening, the cross sectional area of the path for the melt is naturally much smaller than that of the introduction opening to inevitably raise the spinning pressure. Further, the cost of preparing the molded element having a particular shape may be quite high.

SUMMARY OF THE INVENTION

An object of the present invention is to provide a spinning nozzle capable of easily preparing carbon fibers of a random structure having no cracks.

Another object or the invention is to provide a spinning nozzle capable of preparing carbon fibers having a uniform fiber diameter, and a uniformly random structure.

A further object of the invention is to provide a spinning nozzle in which one or more so-called springs made of a spirally molded linear member are equipped in the introduction opening thereof capable of easily preparing carbon fibers of a random structure having no cracks.

The above carbon fibers can be prepared at a low cost by employing the spinning nozzle of the present invention which may be equipped with inexpensive and uniform spiral members preferably formed of commercially available metallic springs in the nozzle openings.

Since the spiral member equipped in the spinning nozzle does not form a path for a melt between the inner wall of an introduction opening wall and itself and the diameter of the spiral member is generally small, the increase of the pressure drops in the respective openings seldom take place.

When the pitch-based carbon fibers are prepared employing a conventional spinning nozzle, the carbon fibers prepared likely possess a radial structure perpendicular to the wall of the spinning nozzle. Disadvantageously, the radial structure is liable to produce cracks during the processes of infusibilization and heat treatment thereafter.

When, to the contrary, the melted pitch which is the starting material of the carbon fibers is introduced to the introduction opening of the spinning nozzle of the present invention equipped with the above-mentioned spiral member, part of the pitch flows down along the spiral member to the discharge opening of the said spinning nozzle while the flow of the pitch is affected by the spiral member. The remaining pitch flows into the discharge opening after or without contact with the spiral member, and is subjected to little influence by the spiral member. The orientation of the melted pitch immediately before the discharge opening is random by means of the mixing of the said two pitches, so that the pitch-based carbon fibers of high modulus of elasticity, and of high strength having the desired random structure can be obtained by means of spinning the mixed pitch through the discharge opening without producing cracks during the subsequent infusibilization process and the heat treatment process.

When the spiral member having an outer diameter of spiral which is uneven is employed, the amount of the pitch which reaches to the discharge opening without being influenced by the spiral member decreases so as to further elevate the degree of the randomness of the pitch-based carbon fibers prepared to enable the preparation of the pitch-based carbon fibers having excellent properties.

DETAILED DESCRIPTION OF THE INVENTION

The spinning nozzle of the present invention is characterized by the presence of one or more spiral members in the introduction opening located upstream the discharge opening of the said spinning nozzle. Part of melted pitch, raw material of carbon fibers, supplied in the introduction opening equipped with the said spiral member flows down along the spiral member while being subjected to a change of the flow path, to reach into a discharge opening of the spinning nozzle, while the remaining pitch flows into the discharge opening without being contacted with the spiral member or under the conditions slightly affected by the spiral member after the contact therewith. The orientation of the melted pitch is made to be random immediately before the discharge opening by means of the mixing of the two pitches to enable the preparation of the pitch-based carbon fibers of the high modulus of elasticity and the high strength. Since the pitch spirally flows down along the spiral member to make its orientation random in the spinning nozzle of the invention, the carbon fibers with the above characteristics can be assuredly prepared.

The spinning nozzle of the present invention itself may be any one of the conventional ones without modification, and the number of the introduction openings and the discharge openings formed in the nozzle may be one or more. One or more of the spiral members are placed in each introduction opening of the nozzle to provide the spinning nozzle of this invention.

The spiral member possesses, as mentioned earlier, the function of descending the part of the pitch introduced in the introduction opening along itself, and its material and shape are not especially restricted as long as the function is effectively performed. The material of the spiral member is desirably stainless steel which does not deteriorate the pitch so that, for example, a commercially available spring may be employed. The spiral member can be formed by spirally deforming a linear member or a tape-like member. If the dimensions of the linear member or the tape-like member constituting the spiral member are too small, the pitch cannot flow down along the spiral member even when the pitch is in contact with the spiral member but may flow in the perpendicular direction. The dimensions of the linear member and of the tape-like member of the spiral member are preferably made within 0.01 to 0.3 with respect to the inner diameter of the introduction opening.

Figure 1:
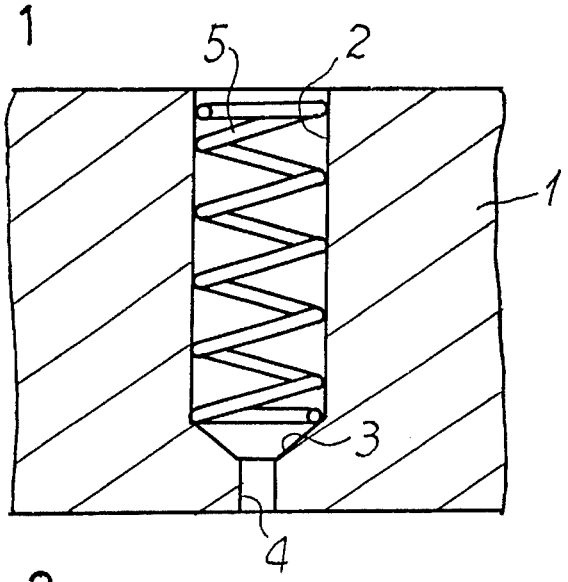
FIG. 1 is a schematic longitudinal cross-sectional view of a first embodiment of a spinning nozzle for producing pitch-based carbon fibers according to the present invention.
Figure 2:
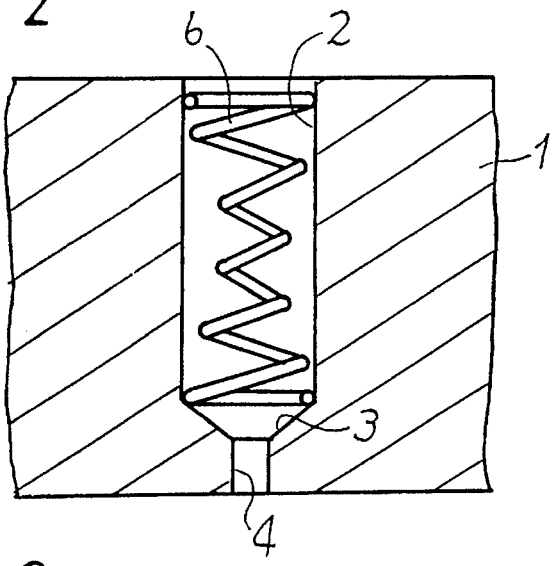
FIG. 2 is a schematic longitudinal cross-sectional view of a second embodiment of a spinning nozzle according to the present invention.

The outer diameters of the spiral can be made equal in the vertical direction so that the outside of the spiral may be in contact with the inner wall of the introduction opening as shown in FIG. 1. The outer diameters of the spiral can be varied in the vertical direction, for example, the outer diameters of the upper and lower ends of the spiral may be larger and the outer diameter of the central portion may be smaller to form a concave on the central portion as shown in FIG. 2, or to form a convex thereon, or to form a wave-like concave-convex surface, so that part of the outside of the spiral may be in contact with the inner wall of the introduction opening. When the outer diameters of the spiral are uneven, a lesser amount of the pitch reaches to the discharge opening without being subjected to the change of flow by means of the spiral member so that the degree of randomness of the pitch-based carbon fibers prepared is much more elevated to enable the preparation of the pitch-based carbon fibers with high modulus of elasticity and high strength.

Although the spinning can be conducted at a temperature higher by 10° to 50° C. than the softening point of pitch (according to the Metler method) in the case that the optically anisotropic pitch is spun employing a conventional spinning nozzle, the carbon fibers thus prepared have a radial structure so as to generate the cracks. Further, the stable spinning is difficult to be conducted outside of the above spinning temperature range. The stable carbon fibers having the random structure with no cracks can be obtained in the above spinning temperature range when the nozzle of the present invention is employed.

While the carbon fibers made of the optically anisotropic pitch are likely to possess a high modulus of elasticity, a heat-treating temperature of more than 2600° C. is generally required to give a modulus of elasticity of not less than $70\times10^3$ kgf/mm$^2$. Since the carbon fibers having the random structure generating no cracks and having the high degree of orientation are prepared by employing the spinning nozzle of the present invention, a modulus of elasticity of $70\times10^3$ kgf/mm$^2$ to $80\times10^3$ kgf/mm$^2$ can be obtained under 2600° C. Especially when the outer diameter of the central portion of the spiral equipped in the introduction opening of the nozzle is reduced, the carbon fibers of high strength can be easily prepared such that the carbon fibers having tensile strength of more than 400 kgf/mm$^2$ and a modulus of elasticity of more than $70\times10^3$ kgf/mm$^2$ are prepared at a heat-treating temperature of less than 2600° C.

DESCRIPTION OF PREFERRED EMBODIMENTS

Embodiments of the spinning nozzles of the present invention will be described referring to the annexed drawings.

Figure 3:
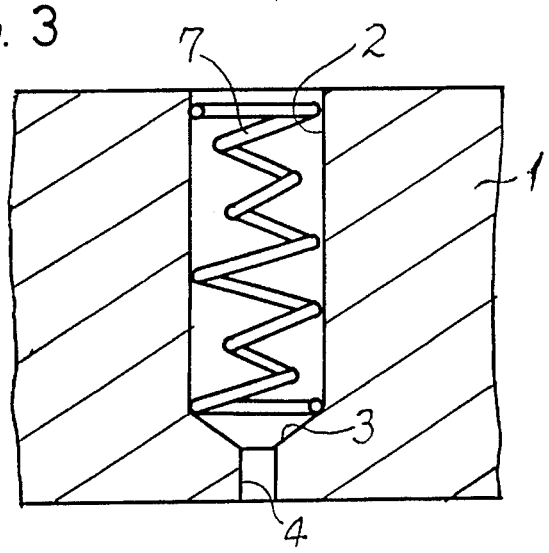
FIG. 3 is a schematic longitudinal cross-sectional view of a third embodiment of a spinning nozzle according to the present invention.

A spinning nozzle 1 is perforated with a vertical introduction opening 2, and the downstream portion thereof through a taper portion 3 is perforated with a short discharge opening 4 having a diameter which is smaller than that of the introduction opening 2. In the introduction opening 2 of FIG. 1, a spiral member 5 is located such as a metal spring, the coils of which have uniform outer diameters in the vertical direction of the spiral formed by spirally shaping a straight wire In the introduction opening 2 of FIG. 2, a spiral member 6 is located having an outer diameter of the spiral at the central portion in the vertical direction which is somewhat smaller. In the introduction opening 2 of FIG. 3, a spiral member 7 is located having outer diameters of the spiral which are made smaller twice between the top of opening 2 and the taper portion 3.

When melted pitch is introduced through the introduction opening of these spinning nozzles, for example, the spinning nozzle 1 of FIG. 1 while heating the spinning nozzle 1, the pitch introduced to the circumference of the introduction opening 2 spirally flows down in the introduction opening 2 along the inner wall of the introduction opening 2 while being in contact with the spiral member 5 to reach the discharge opening 4 in the form of the melted pitch having random orientation. On the other hand, the pitch supplied to the center of the introduction opening 2 moves down in the vertical direction while being affected by the spiral member 5 though the pitch is not in contact with the spiral member 5.

The pitch introduced to the circumference spirally flowing down in contact with the spiral member 5 gradually begins to move inward to the inner part of the introduction opening 2 to exert an influence to the pitch flowing down in the central portion. The pitch in the central portion reaches to the discharge opening 4 after the orientations thereof have been gradually made random. When the pitch is spun during the passage of the discharge opening 4, the pitch-based carbon fibers having the cross section of random orientation can be obtained.

When the pitch-based carbon fibers are prepared similar to the case of FIG. 1 employing the spinning nozzle of Fig. 2, the orientation is more likely to be converted into a random orientation because the melted pitch flowing down in the central part may get at the smaller spiral diameter portion in contact with the spiral member 6. Accordingly, the degree of randomness of the carbon fibers obtained employing the spinning nozzle of FIG. 2 is higher than that obtained employing the spinning nozzle of FIG. 1. In other words, the pitch-based carbon fibers having the higher modulus of elasticity and the higher strength can be prepared by the spinning nozzle of FIG. 2. In the case of the spinning nozzle of FIG. 3, the pitch-based carbon fibers having the high performances can be prepared similar to the case employing the spinning nozzle of FIG. 2 because the spiral has two small diameter portions.

EXAMPLES

Although Examples of the preparation of the pitch-based carbon fibers employing the spinning nozzle of the present invention will be described, the nozzles of the present invention are not restricted thereto.

Example 1

Petroleum pitch containing 100% of optically anisotropic components and having a softening point of 300° C. (according to Metler method), 85% of toluene insoluble content and 47% of quinoline insoluble content was spun employing the spinning nozzle shown in the drawings. The diameter of the introduction opening of the spinning nozzle was 2 mm and the depth was 10 mm, and the diameter of the discharge opening was 0.15 mm, the length was 0.3 mm and the introduction angle was 150°.

A stainless steel wire having a diameter which was 0.4 mm was shaped into a spiral member shown in FIG. 2 having the spiral outer diameters at the upper and lower ends of 2 mm, the spiral outer diameter at the central part of 1 mm and the interval of 1.0 mm. The spiral member was equipped in the introduction opening so that the lower end of the spiral member was in contact with the upper portion of the taper portion.

The pitch fibers having a diameter of 13 microns were obtained after the petroleum pitch was spun employing the above spinning nozzle at a spinning temperature of 325° C. and a spinning speed of 300 m/min. Further the pitch fibers were subjected to the treatment, of infusibilization in air by raising the temperature up to 300° C. at a rate of 3° C./min.

The properties of the carbon fibers prepared after the heat treatment were measured. The tensile strength (TS) was 370 kgf/mm$^2$ and the tensile modulus of elasticity (TM) was $20\times10^3$ kgf/mm$^2$ when the heat-treating temperature (HTT) was 1300° C. (temperature for carbonization). The tensile strength was 440 kgf/mm$^2$ and the tensile modulus of elasticity was $72\times10^3$ kgf/mm$^2$ when the heat-treating temperature (HTT) was 2500° C. (temperature for graphitization). The cross sectional structure of the carbon fibers prepared was uniform, compact and random, and had no cracks. These results are summarized in Table 1.

TABLE 1

| | Spiral Member | Spinning Temp. °C. | Spinning Speed m/min. | Properties of Carbon Fibers ($kgf/mm^2$) HTT1300° C. | HTT2500° C. | Cross Sectional Structure of Carbon Fibers |
|---|---|---|---|---|---|---|
| Exam. 1 | Outer diameter of Center was Small | 325 | 300 | TS 370 TM $20 \times 10^3$ | TS 440 TM $72 \times 10^3$ | Uniform, compact and random structure |
| Exam. 2 | Outer diameter of Center was Small | 340 | 600 | TS 350 TM $19 \times 10^3$ | TS 410 TM $80 \times 10^3$ | Uniform, compact and random structure |
| Exam. 3 | Outer diameter was uniform | 325 | 300 | TS 300 TM $20 \times 10^3$ | TS 380 TM $69 \times 10^3$ | Random structure |
| Comp. Exam. 1 | None | 320 to 340 | 300 & 600 | 90% of cracks were produced | — | Radial structure containing cracks |

Example 2

The pitch-based carbon fibers were obtained employing the same starting material and the spinning nozzle as those of Example 1 and the same conditions of Example 1 except that the spinning temperature was 340° C. and the spinning speed was 600 mm/min. The cross sectional structure of the carbon fibers prepared was uniform, compact and random as Example 1 and the properties thereof were summarized in Table 1. The tensile modulus of elasticity when the heat-treating temperature was made to be 2500° C. by elevating the spinning temperature increased, and the carbon fibers of high strength and high tensional modulus of elasticity could be prepared.

Example 3

The pitch fibers were obtained under the same conditions as those of Example 1 except that the spinning nozzle shown in FIG. 1. having the spiral member having uniform outer diameters of the spiral was employed. The properties of the carbon fibers are summarized in Table 1. Although the properties were somewhat deteriorated by means of making the outer diameters of the spiral even, the cross sectional structure was generally random and had no cracks.

Comparative Example 1

The pitch-based carbon fibers were prepared under the same conditions as those of Example 1 except that the spiral member was not employed. Although the measurement of the properties of the carbon fibers was tried, it could not be conducted because the cracks were produced on 90% of the carbon fibers. All the cross sectional structures were radial structures and many cracks were observed. It is found from these results that the structure of the carbon fibers prepared becomes random to prepare the pitch-based carbon fibers of high modulus of elasticity and of high strength when the spiral member is present in the introduction opening.

What is claimed is:

1. A spinning nozzle having one or more discharge openings and one or more introduction openings located upstream from the discharge openings for producing pitch-based carbon fibers, the nozzle further having means for guiding a flow of melted pitch through the introduction openings consisting of one or more spiral members formed by spirally deforming a linear member or a tape member and having a vacant central portion and being present in each introduction opening whereby when the melted pitch is passed from an introduction opening to a discharge opening a part of the melted pitch flows down along the one or more spiral members and the remaining melted pitch flows down vertically in the vacant central portion of the one or more spiral members without contact with the one or more spiral members.

2. The spinning nozzle as claimed in claim 1, wherein the one or more spiral members have an outer diameter which is uneven.

3. The spinning nozzle as claimed in claim 1, wherein the one or more spiral members are springs.

4. The spinning nozzle as claimed in claim 3, wherein the one or more spiral members have an outer diameter which is uneven.

* * * * *